US007897218B2

(12) United States Patent
Missell et al.

(10) Patent No.: US 7,897,218 B2
(45) Date of Patent: Mar. 1, 2011

(54) RECORDING ELEMENT FOR AQUEOUS INKS

(75) Inventors: Gregory E. Missell, Penfield, NY (US); Lawrence P. DeMejo, Rochester, NY (US); Terry C. Schultz, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 622 days.

(21) Appl. No.: 11/965,065

(22) Filed: Dec. 27, 2007

(65) Prior Publication Data

US 2009/0169777 A1 Jul. 2, 2009

(51) Int. Cl.
*B41M 5/40* (2006.01)

(52) U.S. Cl. ..... 428/32.22; 428/32.21; 428/32.24; 428/201; 428/206; 428/211.1; 428/219; 428/325; 428/341; 428/423.1; 428/480; 428/481; 428/500; 428/537.5; 347/95; 347/105

(58) Field of Classification Search ..... 428/32.21, 428/32.22, 32.24, 201, 206, 211.1, 219, 325, 428/341, 423.1, 480, 481, 500, 537.5; 347/95, 347/105

See application file for complete search history.

(56) References Cited

U.S. PATENT DOCUMENTS

| | | | | |
|---|---|---|---|---|
| 5,302,437 | A | 4/1994 | Idei et al. | |
| 5,928,787 | A | 7/1999 | Owatari et al. | |
| 6,436,514 | B1 | 8/2002 | Ishiyama et al. | |
| 6,638,585 | B2 * | 10/2003 | Niu et al. | 428/32.22 |
| 2001/0024713 | A1 * | 9/2001 | Quintens et al. | 428/195 |
| 2002/0192436 | A1 * | 12/2002 | Voeght et al. | 428/195 |

FOREIGN PATENT DOCUMENTS

| | | |
|---|---|---|
| EP | 0 524 635 | 1/1993 |

* cited by examiner

*Primary Examiner*—Betelhem Shewareged
(74) *Attorney, Agent, or Firm*—Chris P. Konkol; Andrew J. Anderson

(57) ABSTRACT

The present invention is directed to an image-recording medium comprising a paper support and, coated on one side of the support, in order: a lower ink-receiving layer, an upper gloss layer and, coated on the opposite side of the support, an inner layer comprising at least 75% by weight of fine inorganic particles and a binder, and an outer layer substantially consisting of a polymeric material. Another aspect of the present invention relates to an inkjet printing process.

17 Claims, No Drawings

RECORDING ELEMENT FOR AQUEOUS INKS

FIELD OF THE INVENTION

The invention relates generally to the field of printing, and in particular to a recording element for aqueous inks. More specifically, the invention relates to a recording element in cut-sheet form with improved transport in a printer and reduced propensity for curling.

BACKGROUND OF THE INVENTION

Aqueous inks are often the most suitable type for the process of desktop printing, which has become nearly ubiquitous in home and office environments with the advanced personal computers and inkjet printers now available. Possessing a hydrophilic nature in order to absorb the ink, ink-receptive media are in dynamic equilibrium with the environment with regard to moisture. Hydrophilic materials tend to expand as moisture is absorbed. Differential expansion within a multi-layered material will result in curl. Usually photo-quality media are intended for printing on one side only and hence the expensive coatings necessary to provide excellent image quality are provided on only one side of the recording material. Differential absorption of environmental moisture by asymmetrically-coated media may lead to undesirable curl. Even symmetrically-coated media may curl when printed with aqueous ink on one side.

For aesthetic as well as practical reasons, curl of inkjet photo paper is undesirable. Coated paper may exhibit a tendency to curl in response to environmental factors, most importantly the relative humidity, or in response to wetting or drying, for example, during printing or during manufacture. Curl may be induced in a coating through unsymmetrical treatment during the manufacturing stage or by humidity changes prior to its use in a printer. Curled paper may be unsuitable for accurate picking and feeding by the printer. Even uncurled paper may curl upon rewetting by applied ink and produce a head strike or fail to transport. Finally, curled prints may collide in the output tray of the printer. For these reasons, the phenomenon of curl can be a complex phenomenon. Nevertheless, manufacturers wish to minimize the curl of inkjet receivers under a variety of conditions.

A back coating on the side of the support opposite to the image-receiving layer is known to provide a reduction in curl by balancing the curl propensity of both sides of the recording sheet. For example, Idei et al. disclose, in U.S. Pat. No. 5,302,437, a back coat layer comprising inorganic particles and a binder and recommend that the difference in coating weight between front and back coatings be minimized. Even though the curl may be reduced, problems with reliable picking and feeding of media by a printer transport mechanism can remain.

Pre-cut standard-size recording materials held in a stack are universally accepted for desktop printers as a matter of convenience. The printer transport mechanism includes means for picking one sheet from the supply stack at the beginning of the printing process. Reliable picking of exactly one sheet requires that the sheet maintains non-slip contact with the printer transport mechanism, usually including a set of compliant rollers, and easily slides from the media supply stack. Failure to "pick" or the picking of multiple sheets at one time are problems arising from recording materials with surface properties unsuitable for manipulation by the printer's sheet-feeding mechanism.

The sliding of one sheet from a stack is influenced by the front-to-back static coefficient of friction and the adhesion of the backside to the transport roller. Owatari et al. disclose, in U.S. Pat. No. 5,928,787, a backside coating of aqueous binder and higher fatty acid salt. The problem with this approach is that large amounts of expensive polymer are needed to compensate for the curl propensity of high coat weights on the front side of photographic quality media.

Ishiyama et al. disclose, in U.S. Pat. No. 6,436,514, a porous image-recording element with an ink-receiving layer and a gloss layer on the front side of the support and on the side of the support opposite these coated layers, a layer comprising a pigment and a binder, where the static coefficient of friction between the gloss layer and the back-coat layer is 0.9 or less under the conditions of 20° C. and 65% relative humidity ("RH").

When the binder amount in the backside layer is low, transport in the printer can tend to be unreliable under conditions of low temperature and low humidity. Furthermore, the integrity of the backside layer may be low, resulting in the problem of dust formation in the manufacturing operations of slitting and cutting the media and in transporting the media through a printer. Another problem with low backside integrity is the flaking of the backside when an adhesive is applied to the backside for mounting purposes. On the other hand, if the binder level in the coating composition for the back side is significantly increased, the viscosity of the coating composition increases, and its composition must be diluted, resulting in an increased drying requirement or reduced manufacturing productivity.

PROBLEM TO BE SOLVED BY THE INVENTION

It is an object of this invention to provide a glossy, porous ink-receiving medium with reduced propensity for curl under various conditions, improved reliability in the picking and feeding of cut media sheets in a printer, and a high integrity of the backside coating.

SUMMARY OF THE INVENTION

The present invention is directed to overcoming one or more of the problems set forth above. Briefly summarized, according to one aspect of the present invention, there is provided an image-recording medium comprising a support and, coated on one side of the support, at least one ink-receiving layer, and, coated on the opposite side of the support, an inner layer comprising at least 50% by weight of fine inorganic particles and binder, and an outer layer substantially consisting of polymeric material.

Another aspect of the present invention relates to an inkjet printing process comprising inkjet printing on the above-described inkjet recording medium.

ADVANTAGEOUS EFFECT OF THE INVENTION

The ink-recording medium of the present invention provides glossy, photographic quality images, reliably lays relatively flat, and is reliably picked from a stack and transported by a printing mechanism. The integrity of the backside layer is sufficient to prevent dusting or delamination during manufacturing operations, printing, and mounting. Importantly, the propensity for curl, under a variety of conditions, is significantly reduced by the use of the present invention.

Particle sizes referred to herein, unless otherwise indicated, are median particle sizes as determined by light scattering measurements of diluted particles dispersed in water, as measured using laser diffraction or photon correlation spectroscopy (PCS) techniques employing NANOTRAC (Microtac Inc.), MALVERN, or CILAS instruments or essentially equivalent means, which information is often provided in product literature. For particle sizes greater than 0.3 micrometers, particle measurements are by a Micromeritics SediGraph® 5100 or equivalent means. For particle sizes not more than about 50 nm, particle measurements are by direct methods, transmission electron microscopy (TEM) of a representative sample or equivalent means. Unless otherwise indicated particle sizes refer to secondary particle size.

As used herein, the terms "over", "above", "upper", "under", "below", "lower", and the like, with respect to layers in inkjet media, refer to the order of the layers over the support, but do not necessarily indicate that the layers are immediately adjacent or that there are no intermediate layers.

DETAILED DESCRIPTION OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of an aqueous mixture, for example, comprising water and one or more organic materials such as a monohydric alcohol, a polyhydric alcohol, or the like.

An inkjet recording element typically comprises a support having on at least one surface thereof at least one ink-receiving layer, or "IRL," comprising a porous coating of inorganic, polymeric, or organic-inorganic composite particles, a polymeric binder, and optional additives such as dye-fixing agents or mordants. These particles can vary in chemical composition, size, shape, and intra-particle porosity. In this case, the printing liquid is absorbed into the open interconnected pores of the IRL, substantially by capillary action, to obtain a print that is instantaneously dry to the touch. Typically the total interconnected inter-particle pore volume of porous media, which may include one or more layers, is more than sufficient to hold all the applied ink forming the image.

Basically, organic and/or inorganic particles in a porous layer form pores by the spacing between the particles. The binder is used to hold the particles together. However, to maintain a high pore volume, it is desirable that the amount of binder is limited. Too much binder would start to fill the pores between the particles or beads, which would reduce ink absorption. On the other hand, too little binder may reduce the integrity of the coating, thereby causing cracking.

A porous inkjet recording medium that is glossy has one or more ink-receiving layers. An inkjet recording medium designed exclusively for use with pigment-based inks, during inkjet printing, may have only a single coated layer. However, inkjet recording media designed for use with either dye-based inks or pigment-based inks, or both, usually contain at least two coated ink-receiving layers, of different composition, over a support: a base layer nearer to the support and a glossy image-receiving layer, or "gloss layer" further from the support.

The skilled artisan will appreciate that many factors may affect the curl propensity of inkjet recording media. For example, in the case of a paper support, those factors that make strong contributions to water absorption and stiffness are particularly noteworthy, for example, the source of fibers, whether hard or soft wood, the basis weight of the paper, the type and amount of filler, the type and amount of sizing, and the paper making process, including drying and calendering. The nature of the imaging side coating and its method of manufacture, in particular, initial water content and drying process interact with the support to determine the curl propensity of the uncompensated inkjet media.

In manufacturing an inkjet recording element of the present invention, the skilled artisan will make adjustments within the scope of the present invention according to the inherent tendency of the media to curl.

As indicated above, the present invention is directed to an inkjet recording element comprising a support having a frontside and a backside, wherein the inkjet recording element comprises:

(a) on the frontside of the support, one or more porous ink-receiving layers, wherein the total coverage of the one or more ink-receiving layers is at least 15 g/m$^2$, preferably at least 20 g/m$^2$ and, in some embodiments (especially comprising alumina or hydrated alumina), at least 25 g/m$^2$; and (b) on the backside of the support, in order from the support, the following coated layers:

(i) a porous first backside layer comprising inorganic particles and 4% to 50%, by weight solids, polymeric binder, wherein the coverage of the first backside layer is from 2 to 50 g/m$^2$; and (ii) a non-porous topmost second backside layer, over the porous first backside layer, that comprises at least 75%, preferably at least 85%, by weight solids, more preferably at least 95%, polymer material, wherein the coverage of the second backside layer is from 2 to 10 g/m$^2$. Such a non-porous layer does not contain interconnecting pores formed by particles and preferably contains essentially no particles that allow for capillary action of liquids. Most preferably, particles are essentially absent from the surface of the layer, such that the coefficient of friction of the backside of the inkjet recording element is essentially determined by the polymeric content of the non-porous topmost second backside layer.

With respect to the backside layers, the inorganic particles in the porous first backside layer are preferably selected from the group consisting of clay (preferably kaolin), calcium carbonate, boehmite, or combinations thereof. In a preferred embodiment, the inorganic particles in the porous first backside layer have at least one dimension below 1 micrometer. Thus, flatter particles may be used that have a larger maximum dimension than spherical particles. Unless otherwise indicated, size refers to median size, as indicated above.

In a particularly preferred embodiment, the inkjet recording element of the present invention has a porous first backside layer in which the inorganic particles are selected from kaolin, boehmite and/or calcium carbonate and have a median particle size of 100 nm to 2 micrometers. More preferably, the inorganic particles in a porous first backside layer are at least 65%, more preferably at least 80% the same type of material among the three types, kaolin, boehmite and/or calcium carbonate.

Any suitable polymeric material may be used in the porous first backside layer, as a binder, or in the non-porous second backside layer. In a preferred embodiment, the polymeric material is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin. In general, good results are also obtained with polyurethanes, vinyl acetate-ethylene copolymers, ethylene-vinyl chloride copolymers, vinyl acetate-vinyl chloride-ethylene terpolymers, acrylic polymers, or derivatives thereof. Preferably, the binder is a water-soluble hydrophilic polymer, most preferably polyvinyl alcohol or the like.

Other polymeric materials can also be used such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like. A poly(styrene-co-butadiene) latex is a preferred hydrophobic material. Mixtures of hydrophilic and latex binders can be used, for example, a mixture of PVA (polyvinyl alcohol) with a poly (styrene-co-butadiene) latex.

In order to impart mechanical durability to the porous first backside layer or the non-porous topmost second backside layer, crosslinkers which act upon the polymeric material discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid or a borate salt and the like may be used. Preferably, the crosslinker is an aldehyde, an acetal or a ketal, such as 2,3-dihydroxy-1,4-dioxane.

For the non-porous topmost second layer, the polymer material, as indicated above, can be a hydrophilic or hydrophobic polymer material. Preferred hydrophilic polymers are polyester, polyurethane, polyvinyl pyrrolidone, or polyvinyl alcohol or modified polyvinyl alcohol. Most preferably, the polymer material in the non-porous topmost second backside layer is poly(vinyl alcohol). In the case of a hydrophobic polymer material in the non-porous topmost second backside layer, preferred examples include styrene-butadiene or a poly (urethane).

Preferably, the coated layers on the backside of the support are sufficiently transparent to near infra-red radiation to allow a printer to reliably detect a coded indicia that absorbs infra-red that is printed on back of the support.

Although it may very well depend on the materials involved in the support or front side coatings and backside coatings, in one particular embodiment, the ratio of the total coverage of the coated layers on the backside to the total coverage of the ink-receiving layers on the frontside of the support is 25 to 65 percent, preferably 30 to 60 percent.

In one embodiment of the present invention, the inorganic particles in the porous first backside layer comprise predominantly calcium carbonate particles. The term "precipitated calcium carbonate" is used herein to define a synthetically produced calcium carbonate, not based on calcium carbonate found in nature. Preferably, in such an embodiment, the porous first backside layer comprises particles of precipitated calcium carbonate in an amount greater than 65 weight percent, based on the total inorganic particles in the layer. The precipitated calcium carbonate can comprise scalenohedral, prismatic, acicular, or rhombohedral morphology, and combinations thereof.

In particular, in one embodiment, the porous first backside layer comprises a binder, preferably in an amount of 5 to 15 weight %, more preferably 6 to 12 weight percent, and at least 80% by weight of calcium carbonate particles, preferably having an median particle size of 0.4 to 5 micrometers, with a preferred size of less than 3 μm, more preferably less than 2 μm, most preferably about 0.4 to 2 μm, for example, 0.5 to 1.5 micrometers.

Examples of scalenohedral calcium carbonate that can be used include various ALBACAR PCC products available from Specialty Minerals Inc. (subsidiary of Minerals Technologies Inc.). Scalenohedral PCC materials available from Specialty Minerals include ALBACAR HO, ALBACAR 5970 and ViCALityt® Extra Light. Examples of other types of precipitated calcium carbonate include ALBAGLOS and ALBAFIL PCC's (prismatic), OPACARB PCC (acicular), and ViCALity® Heavy PCC (cubic), products also available from Specialty Minerals Inc. Other companies making PCC's include Pfizer and Solvay.

In one preferred embodiment, the porous first backside layer comprises precipitated calcium carbonate in admixture with up to 40 percent by weight of other particles, based on the total weight of inorganic particles, either organic and/or other inorganic particles, including organic-inorganic composite particles, for example, kaolin clay.

In another embodiment of the present invention, the inorganic particles in the porous first backside layer are comprised predominantly of hydrated alumina particles. As will be appreciated by the skilled artisan, the term "hydrated alumina" is herein defined by the following general formula:

$$Al_2O_{3-n}(OH)_{2n}.mH_2O$$

wherein n is an integer of 0 to 3, and m is a number of 0 to 10, preferably 0 to 5. In many cases, $mH_2O$ represents an aqueous phase which does not participate in the formation of a crystal lattice, but is able to be eliminated. Therefore, m may take a value other than an integer. However, m and n are not 0 at the same time.

A crystal of the hydrated alumina showing a boehmite structure is generally a layered material the (020) plane of which forms a macro-plane, and shows a characteristic diffraction peak. Besides a perfect boehmite, a structure called pseudo-boehmite and containing excess water between layers of the (020) plane may be taken. The X-ray diffraction pattern of this pseudo-boehmite shows a diffraction peak broader than that of the perfect boehmite. Since perfect boehmite and pseudo-boehmite may not be clearly distinguished from each other, the term "boehmite" or "boehmite structure" is herein used to include both unless indicated otherwise by the context. For the purposes of this specification, the term "boehmite" implies boehmite and/or pseudoboehmite.

Boehmite and pseudoboehmite are hydrated aluminas, in particular aluminum oxyhydroxides which are herein defined by the general formula $\gamma$-$AlO(OH)xH_2O$, wherein x is 0 to 1. When x=0 the material is specifically boehmite as compared to pseudo-boehmite; when x>0 and the materials incorporate water into their crystalline structure, they are known as pseudoboehmite. Boehmite and pseudoboehmite are also described as $Al_2O_3.zH_2O$ where, when z=1 the material is boehmite and when $1<z<2$ the material is pseudoboehmite. The above materials are differentiated from the aluminum hydroxides (e.g. $Al(OH)_3$, bayerite and gibbsite) and diaspore ($\alpha$-AlO(OOH) by their compositions and crystal structures.

In particular, in one embodiment, the porous first backside layer comprises a binder, preferably in an amount of 5 to 15 weight %, more preferably 6 to 12 weight percent, and at least 80% by weight of hydrated aluminum particles, preferably having an median particle size of 0.1 to 1.0 micrometers, with a preferred size of less than 0.5 μm, more preferably less than 0.2 μm, most preferably about 0.1 to 0.2 μm.

In still another preferred embodiment of the present invention, the inorganic particles in the porous first backside layer comprise predominantly clay particles.

In particular, in one embodiment, the porous first backside layer comprises a binder, preferably in an amount of 5 to 15 weight %, more preferably 6 to 12 weight percent, and at least 80% by weight of clay particles, preferably having an median particle size of 0.5 to 5.0 micrometers, with a more preferred size of less than 3 μn, most preferably less than 2 μm, for example, about 0.5 to 1.0 μm.

Clay particles can include, for example, kaolin clay, delaminated kaolin clay, calcined clay, and the like. The preferred clay particle is kaolin clay, more preferably exfoliated. Examples of commercially available clays include Hydragloss 90® (Huber), Polygloss 90® (Huber), and Kaofine 90® (Thiele Kaolin). The clays may be dispersed in water alone, or small quantities (less than 1% w/w clay) of anionic dispersants (e.g., Colloid 211®, an anionic polyacrylate) may be added to aid the dispersion process.

In the embodiment in which kaolin or other clay pigment is used in an amount of at least 50 weight percent of total inorganic particles, up to 50% of the inorganic particles in the layer may comprise additional pigment particles, the composition of which may include but is not restricted to calcium carbonate, talc, zeolite, silica, alumina, and titanium dioxide, etc.

The support used in the invention can be any of those usually used for inkjet receivers, such as resin-coated paper, paper, polyesters. The support can alternatively be a porous synthetic polymeric material, for example, a porous extruded polyester or poly(lactic acid), or microporous materials such as polyethylene polymer-containing material sold by PPG Industries, Inc., Pittsburgh, Pa. under the trade name of TESLIN, TYVEK synthetic paper (DuPont Corp.), and OPPALYTE films (Mobil Chemical Co.) and other composite films listed in U.S. Pat. No. 5,244,861.

Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base.

Transparent supports include cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly (butylene terephthalate), and copolymers thereof; polyimides; polyamides; polycarbonates; polystyrene; polyolefins, such as polyethylene or polypropylene; polysulfones; polyacrylates; polyetherimides; and mixtures thereof.

The support for the coated ink-retaining layers is preferably selected from plain papers, more preferably raw (uncoated paper). The tam "plain paper" refers to paper that has less than 1 g/m$^2$ of coating applied over raw paper. The term "raw paper" refers to cellulosic paper the surface of which does not have a continuous layer or coating of a separate material over the cellulose fibers of the paper, although the paper may treated with a sizing agent or may be impregnated with treatment materials over a portion of the surface.

The thickness of the support employed in the invention can be from about 12 to about 500 μm, preferably from about 75 to about 300 μM, for example, raw paper that is 4-5 mil thick (100 micrometers).

Although a wide variety of ink-receiving frontside coating compositions can be used in the inkjet recording element of the present invention, only a few examples will be mentioned. Optionally, an inkjet recording element can comprise, in addition to a porous base layer nearest the support, a porous ink-receiving intermediate layer above the base layer, under an uppermost porous image-receiving or gloss layer.

In one such embodiment, based on dry weight coverages, the base layer, optionally comprising one or more sub-layers, is present in an amount of 15 g/m$^2$ to 60 g/m$^2$, and the upper layer is present in an amount of 1 to 10 g/m$^2$. Preferably, the upper layer comprises most of the mordant in the inkjet media at a relatively high concentration, optionally the sole layer with mordant, preferably in the form of a cationic polymer.

Accordingly, one embodiment of the present invention relates to an inkjet recording element useful for either dye-based or pigment-based inkjet printing comprising, in order, over an absorbent support:

(a) a porous base layer comprising a polymeric binder and at least 80 percent by weight of inorganic particles having a particle size of 0.3 to 5 micrometers;

(b) optionally one or more porous ink-receiving intermediate layer comprising at least 80 percent by weight of inorganic particles; and (c) a porous uppermost gloss layer comprising at least 80 percent, by weight of total inorganic particles, wherein the latter particles have a median particle size of from less than 200 nm, optionally a mixture of particles.

In describing inkjet recording elements, the following definitions generally apply:

The term "porous layer" is used herein to define a layer that is characterized by absorbing applied ink by means of capillary action rather than liquid diffusion. The porosity is based on pores formed by the spacing between particles, although porosity can be affected by the particle to binder ratio. The porosity of a layer may be predicted based on the critical pigment volume concentration (CPVC). An inkjet recording element having one or more porous layers, preferably substantially all layers, over the support can be referred to as a "porous inkjet recording element," even though at least the support is not considered porous.

In regard to the present method, the term "image-receiving layer" is intended to define a layer that is used as a pigment-trapping layer, dye-trapping layer, or dye-and-pigment-trapping layer, in which the printed image substantially resides throughout the layer. Preferably, an image-receiving layer comprises a mordant for dye-based inks. In the case of a dye-based ink, the image may optionally reside in more than one image-receiving layer.

In regard to the present method, the term "base layer" (sometimes also referred to as a "sump layer" or "ink-carrier-liquid receptive layer") is used herein to mean a layer under at least one other ink-retaining layer that absorbs a substantial amount of ink-carrier liquid. In use, a substantial amount, preferably most, of the carrier fluid for the ink is received in the base layer. The base layer is not above an image-containing layer and is not itself an image-containing layer (a pigment-trapping layer or dye-trapping layer). Preferably, the base layer is the ink-retaining layer nearest the support.

The term "ink-receptive layer" or "ink-retaining layer" includes any and all layers above the support that are receptive to an applied ink composition, that absorb or trap any part of the one or more ink compositions used to form the image in the inkjet recording element, including the ink-carrier fluid and/or the colorant, even if later removed by drying. An ink-receptive layer, therefore, can include an image-receiving layer, in which the image is formed by a dye and/or pigment, a base layer, or any additional layers, for example between a base layer and a topmost layer of the inkjet recording element. Typically, all layers above the support are ink-receptive. The support on which ink-receptive layers are coated may also absorb ink-carrier fluid, in which it is referred to as an ink-absorptive or absorbent layer rather than an ink-receptive layer.

The layers may optionally be divided into sub-layers, preferably immediately adjacent sub-layers, in which case independently the sub-layers individually and collectively meet the limitations of the layer. Preferably, if sub-divided, then only 2 or 3 sub-layers are present making up the layer.

Preferably, the unprinted inkjet recording element exhibits a 20-degree gloss of at least 15 Gardner gloss units. More preferably, the 60-degree gloss of the unprinted inkjet recording element is at least 40 Gardner gloss units, more preferably the 20-degree gloss is at least 20 Gardner gloss units and the 60-degree gloss is at least 50 Gardner gloss units.

In a preferred embodiment, the present inkjet recording media provides photographic image quality and an ability to absorb an ink flux of at least $5.0\times10^{-4}$ mL/cm$^2$/sec without loss of image quality. This ink flux corresponds to printing a 4-inch by 6-inch photograph at an addressable resolution of 1200 by 1200 pixels per inch with an average ink volume of 10.35 picoliters (pL) per pixel in 42 seconds, wherein the printing of a given pixel by multiple coating passes is complete in less than 4 seconds.

In one particular embodiment, the base layer comprises inorganic particles, for example, calcium carbonate, magnesium carbonate, insoluble sulfates (for example, barium or calcium sulfate), hydrous silica or silica gel, silicates (for example aluminosilicates), titanium dioxide, talc, and clay or constituents thereof (for example, kaolin or kaolinite). Preferred particles, for the bulk of the inorganic particles in the base layer, are structured pigments in which the dispersed particles have low or no internal porosity, as compared to microporous pigments. Structured pigments have a non-spherical morphology that does not allow dense packing in the dried coating. Precipitated calcium carbonate (PCC) is an example of a structured pigment that can provide high porosity in inkjet coatings. For example, precipitated calcium carbonate having scalenohedral morphology has been used to provide absorption of inkjet-printing inks. The base layer preferably comprises between 50 percent and 90 percent by weight of the inorganic particles.

In such an embodiment, for the layers above the base coat, the top ink-receiving layer and any optional intermediate layers, comprise inorganic particles selected from metal-oxide particles that can be divided roughly into particles that are made by a wet process and particles made by a dry process (vapor phase process). The latter type of particles is also referred to as fumed or pyrogenic particles. In a vapor phase method, flame hydrolysis methods and arc methods have been commercially used. The term "flame hydrolysis" is understood to mean the hydrolysis of metal or non-metal compounds in the gas phase of a flame, generated by reaction of a fuel gas, preferably hydrogen, and oxygen. Highly disperse, non-porous primary particles are initially formed which, as the reaction continues, coalesce to form aggregates, and these aggregates may congregate further to form agglomerates. In a preferred embodiment, the BET surface of area of these primary particles are 5 to 600 m$^2$/g. Fumed metallic oxides are produced in a vapor phase process, whereas colloidal metallic oxides are not and can be distinguished from both fumed metallic oxide made by a dry process.

Fumed particles are suitable for forming a three-dimensional structure having high void ratio. Fumed or pyrogenic particles are aggregates of smaller, primary particles. Although the primary particles are not porous, the aggregates contain a significant void volume, and hence are capable of rapid liquid absorption. These void-containing aggregates enable a coating to retain a significant capacity for liquid absorption even when the aggregate particles are densely packed, which minimizes the inter-particle void volume of the coating.

For example, fumed silica, for selective optional use in the present invention, are described in U.S. Pat. No. 6,808,769 to Batz-Sohn et al., U.S. Pat. No. 6,964,992 to Morris et al. and U.S. Pat. No. 5,472,493 to Regan, all hereby incorporated by reference. Examples of fumed silica are provided in the Examples below and are commercially available, for example, from Cabot Corp. under the family trademark CAB-O-SIL silica, or Degussa under the family trademark AERO-SIL silica. Various finned aluminas are also readily commercially available. For example, fumed alumina particles, for selective optional use in the present invention, are described in US20050170107 A1, hereby incorporated by reference.

Preferably, substantially all the particles in a topmost ink-receiving layer gloss-producing layer ("gloss layer"), an image-receiving layer for an inkjet recording element, have an average primary and secondary particle size of not more than 300 nm.

The voids in the gloss layer provide a pathway for an ink to penetrate appreciably into the base layer, thus allowing the base layer to contribute to the dry time. It is preferred, therefore, that the voids in the gloss layer are open to (connect with) and preferably (but not necessarily) have a void size similar to or slightly larger than the voids in the base layer for optimal interlayer absorption. In one embodiment, the upper gloss layer comprises less than 10 weight percent binder, based on total solids in the layer. The binders in the upper gloss layer can be selected from the same binders as in the base layer. Poly(vinyl alcohol) is again the preferred binder, although any of the hydrophilic binders mentioned above can also be used, for example, polyvinyl acetate, polyvinyl pyrrolidone, gelatin, poly(2-ethyl-2-oxazoline), poly(2-methyl-2-oxazoline), poly(acrylamide), chitosan, poly(ethylene oxide), methyl cellulose, ethyl cellulose, hydroxyethyl cellulose, hydroxypropyl cellulose, etc.

The particle-to-binder weight ratio of the particles and optional binder employed in the porous base layer and the gloss-producing ink-receiving layer can range between about 100:0 and 60:40, preferably between about 100:0 and about 90:10. In general, a layer having particle-to-binder ratios outside the range stated will usually not be sufficiently porous to provide good image quality. In a preferred embodiment of the invention, the volume ratio of the particles to the polymeric binder in the both the base layer and the gloss-producing ink-receiving layer is from about 1:1 to about 15:1.

Conventional additives may be included in the ink-receiving layers in the present invention, which may depend on the particular use for the recording element. Such additives that optionally can be included in the ink-receiving layers of the inkjet recording element include cross-linkers, rheology modifiers, surfactants, UV-absorbers, biocides, lubricants, dyes, optical brighteners, and other conventionally known additives. Additives may be added in light of the fact that the ink-receiving layers of the inkjet recording element may come in contact with other image recording articles or the drive or transport mechanisms of image-recording devices, so that additives such as matte particles and the like may be added to the inkjet recording element to the extent that they do not degrade the properties of interest.

All the coated layers of the present inkjet recording element, on the frontside or backside of the support, may be made by various coating methods which may include, but are not limited to, wound wire rod coating, slot coating, slide hopper coating, gravure, curtain coating and the like. Some of these methods allow for simultaneous coatings of two or more layers, which is preferred from a manufacturing economic perspective.

The backside layers may be coated on the backside of the support after the ink-receiving layers such as the gloss layer are coated on the front side, or may be first coated on the backside and then the one or more ink receiving layers may be coated on the front side. However, it is preferred to coat the backside layers on the backside of the support after the ink-receiving layers, including the gloss layer, have been coated.

After coating and drying a backside layer, the layer may be subjected to calendering by conventional calendering apparatuses. However, excess calendering promotes smoothening, which may result in too much increase of the static friction coefficient between the backside layer and the gloss layer to cause troubles in carrying of the sheets in the printer. Thus, appropriate control of the manufacturing process is necessary.

As mentioned above, it is necessary in the present invention to adjust the static friction coefficient between the uppermost layer on the imaging side and the back-coat layer to 0.9 or lower, preferably 0.2 or higher, by suitably selecting kind, amount and coating amount of the pigment and the binder in the uppermost imaging layer, as well as, kind, amount and coating amount of the pigment and the polymeric material in the topmost backside layer. If the static friction coefficient is too low, in the case of stacking a plurality of the sheets, they cannot be stably stacked.

The static back-to-roller or "picking" COF should be greater than the face-to-back COF to allow the roller to slide the media off the stack of media into the printer. The difference between the COF back-to-roller and COF back-to-face should be greater than 0.75, preferably greater than 0.9. The dynamic back-to-roller or "feeding" COF should be greater than the face-to-back COF to allow the media to transport in the printer. The delta COF should be greater than 0.40, preferably greater than 0.6.

Another aspect of the present invention relates to an inkjet printing process comprising the steps of: (A) providing an inkjet printer that is responsive to digital data signals; (B) loading the inkjet printer with an inkjet recording element having a backcoat as described above; (C) loading the inkjet printer with an inkjet ink composition; and (D) printing on the inkjet recording element using the inkjet ink composition in response to the digital data signals.

The following examples further illustrate the invention.

EXAMPLES

Curl Evaluation

Samples of media were tested for curl as manufactured, prior to printing, according to the following procedure. Samples of media were cut to 10 cm×15 cm and conditioned for 24 hours at Condition 1 (12° C. and 20% RH) and additional samples were conditioned at Condition 2 (27° C. and 80% RH. Following the conditioning period, the edge rise was measured at each of the four corners of each sample and the results for ten samples were averaged. Positive curl indicates curl toward the image side and negative curl indicates curl toward the backside. The absolute value of the difference in curl between Conditions 1 and 2 was calculated as "Delta Curl."

Pick and Feed Test

Samples of media were cut to 10 cm×15 cm and placed in stacks of ten. The stacks were conditioned at Condition 1 as in the curl evaluation. Following a 24-hour period of conditioning, a stack was loaded into a KODAK 5300 printer. Ten prints were made consecutively and then the media supply tray was reloaded with additional stacks of ten sheets until 100 prints had been made. The number of transport failures was tabulated. Types of failures observed included failure to pick, failure to feed properly, and feeding two sheets simultaneously.

Scratch Test

The multipoint scratch behavior of the unprinted samples was evaluated according to the following procedure using a Single Arm Scratch device designed and fabricated at Eastman Kodak Company. Samples were conditioned for at least 18 hours at 23° C./50% RH prior to testing. After this conditioning period, three replicate samples of each coating were scratched using an abrader consisting of 3M 268×A TRIZACT film (A35MIC grade). A constant load of 180 grams and a scratch velocity of 25 mm/second were used. After scratch generation was complete, a visual evaluation of the sample was made to categorize the extent of the damage.

The categories used for scratch evaluation were:

1=No visible scratches, no dusting

2=Slight scratches, very slight dusting

3=Visible scratches, moderate dusting

4=Heavy scratches, heavy dusting

5=Damage to surface, coating comes off

Example 1

A paper support comprising Eucalyptus fiber at a base weight of 180 grams/m$^2$ was provided. On the image side a base layer aqueous coating composition comprising calcium carbonate (Albagloss-S®, Specialty Minerals Inc.) silica gel (IJ 624®, Gasil), styrene butadiene latex (CP692NA®, Dow), poly(vinyl alcohol) (Celvol 325®, Celanese Corp.) in the ratio of 65/21/11/2 by dry weight, was bead coated at 30 g/m$^2$ and dried.

A second aqueous coating composition comprising colloidal boehmite (Catapal® 200, Sasol Inc.), poly(vinyl alcohol) (GH23®, Nippon Gohsei), glyoxal (Cartabond GHF®, Clariant), and boric acid at a ratio of 95.38/4.25/0.25/0.12 by dry weight, and a third aqueous coating composition comprising finned alumina PG008®, Cabot Corp), boehmite (Dispal 14N4-80, Sasol), poly(vinyl alcohol) (GH23®, Nippon Gohsei), a mordant (from Eastman Kodak Company), surfactant (Zonyl FSN®, DuPont), glyoxal (Cartabond GHF®, Clariant), and boric acid at a ratio 41.7/36.5/5.3/15.7/0.3/0.3/0.1 by dry weight were simultaneously coated using a slide hopper bead coating technique at 40 g/m$^2$ and 2 g/m$^2$ respectively over the previously coated base layer and dried.

A fourth aqueous coating composition comprising clay (Hydragloss 90®, J.M. Huber Corp), poly(vinyl alcohol) (Mowiol 28-99®, Kuraray Inc), dispersant (Colloid 211®), glyoxal (Cartabond GHF®, Clariant) at a ratio of 91/8/0.9/0.1 by dry weight, and a fifth aqueous coating composition comprising polyvinyl alcohol) (Mowiol 28-99®, Kuraray Inc.)

were simultaneously coated on the side of the support opposite to the image-receiving layers using a slide hopper bead coating technique at 25 g/m$^2$ and 3 g/m$^2$ respectively and dried to provide Example I-1 of the invention.

Comparative examples C-1 to C-4 were prepared identically to example I-1, except the backside coating was altered as follows:

C-1: clay layer only, no PVA top coat

C-2: PVA layer only, no clay layer base coat

C-3: Clay layer only with clay/PVA ratio increased from 91/8 to 80/20.

C-4: no backcoat.

The results of the evaluations for pick and feed, curl, and abrasion resistance are shown in Table 1.

TABLE 1

| Sample | Pick and Feed (% Success) | Edge rise (mm) Condition 1 | Edge rise (mm) Condition 2 | Delta Curl | Scratch |
|---|---|---|---|---|---|
| I-1 | 96% | −8 | +1 | 9 | 1 |
| C-1 | 42% | −5 | +1 | 6 | 5 |
| C-2 | 98% | −12 | +10 | 22 | 1 |
| C-3 | 47% | −5 | +2 | 7 | 4 |
| C-4 | 98% | −18 | +8 | 26 | NA |

The results shown in Table 1 above demonstrate that acceptable curl before printing and nearly error-free "pick-and-feed" and no visible scratches nor dusting are possible with the two-layer backside coating of the invention. If the clay-containing layer closer to the support is omitted, the curl is unacceptable. If the outermost layer consisting essentially of PVA is omitted, a tendency for errors in feeding in a printer mechanism arises.

Coefficient of Static and Dynamic Friction Testing

This test is done to determine the ratio of the frictional force resisting movement of the surface of the media to the force applied normally to that surface (the weight of the media). This was done using an Instron® device that measures the force required to start the media moving from the rest mode (static force) and the force needed to keep the media moving at a constant speed (dynamic force).

The contact surface was 6.5 square centimeters. Measurements were conducted at 23° C. and 50% relative humidity (RH). The dynamic speed was 47 cm/minute and the normal force was 100 grams. These conditions were chosen to replicate what the media would encounter in the Kodak Easyshare 5300® printer.

The coefficient of friction (static and dynamic) was measured for the roller material of the Kodak Easyshare 5300® printer against the back side of the inkjet receiver and for the front side against the back side of the media. The results are shown in Table 2.

TABLE 2

| | COF Face to Back | | COF Back to Roller | | Delta COF | | Pick and Feed |
|---|---|---|---|---|---|---|---|
| Examples | Static | Dynamic | Static | Dynamic | Static | Dynamic | (% Success) |
| I-1 | 0.553 | 0.431 | 1.630 | 1.980 | 1.077 | 1.540 | 96% |
| C-1 | 0.407 | 0.282 | 0.790 | 0.540 | 0.383 | 0.258 | 42% |
| C-2 | 0.525 | 0.403 | 1.520 | 1.630 | 0.999 | 1.277 | 98% |
| C-3 | 0.416 | 0.287 | 0.783 | 0.571 | 0.155 | 0.284 | 47% |
| C-4 | 0.521 | 0.489 | 1.240 | 1.460 | 0.939 | 0.450 | 98% |

The results shown in Table 2 demonstrate that the static back-to-roller or "picking" COF should be greater than the face-to-back COF to allow the roller to slide the media off the stack of media into the printer. The difference between the COF back-to-roller and COF back-to-face should be greater than 0.75. Examples 1-1, C-2, and C-4 meet this requirement. The dynamic back-to-roller or "feeding" COF should be greater than the face-to-back COF to allow the media to transport in the printer. The delta COF here should be greater than 0.40. Examples I-1, C-2, and C-4 meet this requirement.

Example 2

This Example shows the effect of thickness variation of outermost backside layer. A series of coatings was prepared according to the procedure used for Coating I-1 above, except that the dry weight of the PVA in the outermost layer of the back coat was varied from 1 g/m$^2$ to 6 g/m$^2$. After drying, 1 g/m2 of PVA corresponds to approximately 1 micron in thickness. Evaluation of the curl and the pick-and-feed ability was conducted as in Example 1 and the results are shown in Table 3.

TABLE 3

| Coating | PVA Dry Weight (g/m$^2$) | Delta Curl | Pick and Feed (% successful) |
|---|---|---|---|
| C-5 | 1 | 10 | 71% |
| I-2 | 2 | 13 | 91% |
| I-1 | 3 | 9 | 96% |
| I-3 | 4 | 18 | 97% |
| I-4 | 5 | 22 | 97% |
| I-5 | 6 | 36 | 96% |

The results shown in Table 3 demonstrate that at least 2 g/m$^2$ of hydrophilic polymer is desired in the outermost layer of the back coat to obtain more reliable pick-and-feed behavior. The results show that too thick a layer of PVA adversely may affect curl for a given paper and front side coating. In the present example, the upper limit for PVA was reached at 5 to 6 g/m$^2$, but could increase or decrease for different paper support or front side coating.

Example 3

This Example shows the use of alternate binders in outermost layer of the backside layers. A series of coatings was prepared according to the procedure for Example 1, except that different polymers were employed in the outermost layer of the back coat. The pick and feed performance of the coatings was evaluated according to the procedure employed in Example 1. The results are shown in Table 4.

TABLE 4

| Coating | Polymer | Pick and Feed |
|---|---|---|
| I-1 | PVA | 96% |
| I-6 | Polyurethane | 92% |
| I-7 | Polyester (AQ55 ®, Eastman) | 91% |
| I-8 | Styrene butadiene Latex (SB690 ®, Dow) | 78% |
| I-9 | Polyvinylpyrrolidone | 67% |
| C-1 | (No polymer layer) | 42% |

The results shown in Table 4 demonstrate that show that a variety of polymer layers are suitable for the outermost backside layer.

Example 4

This Examples shows the effect of the molecular weight of the polymeric material (PVA) and degree of hydrolysis in the top layer of the backside layers. A series of coatings was prepared according to the procedure for Example 1, except that different types of poly(vinyl alcohol) were employed in the outermost layer of the back coat. The identities and characteristics of the poly(vinyl alcohol)s used are shown in Table 5. The coatings were evaluated as in Example 1 and the results are shown in Table 5.

TABLE 5

| Example | Top Coat PVA | Viscosity 20 ® C (4% aqueous) | Degree of Hydrolysis | Delta Curl | Pick & Feed % Good | Scratch |
|---|---|---|---|---|---|---|
| I-1 | Mowiol ® 28-99 | 28-30 | 99% | 9 | 96% | 1 |
| I-9 | Mowiol ® 26-88 | 26-28 | 88% | 10 | 94% | 1 |
| I-10 | Mowiol ® 20-98 | 20-22 | 98% | 11 | 91% | 1 |
| I-11 | Celvol ® 325 | 32-35 | 99% | 8 | 90% | 1 |
| I-12 | KH-20 ® (Nippon Gohsei) | 44-52 | 78% | 12 | 94% | 1 |
| I-13 | KH-17 ® (Nippon Gohsei) | 32-30 | 78% | 14 | 91% | 1 |

The results shown in Table 5 show acceptable results are achieved using PVA's over a range molecular weight (as represented by the solution viscosity) and saponification degree. The corresponding viscosities range from 20 to 52, and the saponification degree ranges from 78% to 99%.

Example 5

A series of coatings was prepared according to the procedure for Example 1, except that different types of inorganic particles were employed in the inner layer of the back coat. The identities of the fillers used are shown in Table 6 below. The coatings were evaluated as in Example 1 and the results of the evaluation for pick and feed, delta cur, and abrasion resistance are also shown in Table 6:

TABLE 6

| Example | Inorganic particle | Delta Curl | Pick & Feed % Good | Scratch |
|---|---|---|---|---|
| I-1 | Huber Hydagloss-90 ® | 9 | 96% | 1 |
| I-14 | Calcium Carbonate (Albagloss S ®) | 13 | 94% | 1 |
| I-15 | Boehmite Catapal 200 ® | 17 | 93% | 1 |

The results shown in Table 6 show acceptable results are achieved using other inorganic particles to replace the clay in the inner layer of example 1.

The invention has been described with reference to a preferred embodiment; however, it will be appreciated that variations and modifications can be effected by a person of ordinary skill in the art without departing from the scope of the invention.

The invention claimed is:

1. A inkjet recording element comprising a support having a frontside and a backside, wherein the inkjet recording element comprises:

(a) on the frontside of the support, one or more porous ink-receiving layers, wherein the total coverage of the one or more ink-receiving layers is at least 15 g/m$^2$; and (b) on the backside of the support, in order from the support, the following coated layers:

(i) a porous first backside layer comprising inorganic particles and 4% to 50% polymeric binder, by weight solids, wherein the coverage of the first backside layer is from 2 to 50 g/m$^2$; and (ii) a non-porous topmost second backside layer, over the porous first backside layer, that comprises at least 75% polymer material, by weight solids, wherein the coverage of the second backside layer is from 2 to 10 g/m$^2$.

2. The inkjet recording element of claim 1, wherein the inorganic particles in the porous first backside layer are selected from the group consisting of clay, calcium carbonate, boehmite, and combinations thereof.

3. The inkjet recording element of claim 1, wherein the inorganic particles in the porous first backside layer have at least one median dimension below 1 micrometer.

4. The inkjet recording element of claim 3, wherein the inorganic particles in the porous first backside layer are selected from kaolin clay, boehmite or calcium carbonate and have a median particle size of 100 nm to 2 micrometers.

5. The inkjet recording element of claim 4, wherein the inorganic particles comprise kaolin clay.

6. The inkjet recording element of claim 5, wherein the inorganic particles comprise a combination of kaolin clay and calcium carbonate.

7. The inkjet recording element of claim 1, wherein the polymer material in the non-porous topmost second backside layer is selected from the group consisting of polyester, polyurethane, polyvinyl pyrrolidone, polyvinyl alcohol and modified polyvinyl alcohol.

8. The inkjet recording element of claim 1, wherein the polymer material in the non-porous topmost second backside layer is a hydrophilic polymer.

9. The inkjet recording element of claim 8, wherein the polymer material in the non-porous topmost second backside layer is poly(vinyl alcohol).

10. The inkjet recording element of claim 1, wherein the polymer material in the non-porous topmost second backside layer is a hydrophobic polymer.

11. The inkjet recording element of claim 10, wherein the polymer material in the non-porous topmost second backside layer is styrene-butadiene or poly(urethane).

12. The inkjet recording element of claim 1, wherein the inkjet recording element comprises, on the front side of the support, at least two porous ink-receiving layers, at least one base layer and at least one image-receiving layer.

13. The inkjet recording element of claim 1, wherein the support comprises a cellulosic material.

14. The inkjet recording element of claim 1, wherein the support comprises a paper that is not resin coated.

15. The inkjet recording element of claim 1, wherein the coated layers on the backside of the support are sufficiently transparent to near infra-red radiation to allow a printer to effectively detect a coded indicia that absorbs infra-red and that is printed on back of the support.

16. An inkjet recording element comprising a support having a frontside and a backside, wherein the inkjet recording element comprises:

(a) on the frontside of the support, at least two porous ink-receiving layers, wherein the total coverage of the one or more ink-receiving layers is at least 40 $g/m^2$; and (b) on the backside of the support in order from the support, the following coated layers;

(i) a porous first backside layer comprising kaolin particles and 5 to 15% polymeric binder, by weight solids, wherein the coverage of the first backside layer is at least 15 $g/m^2$; and (ii) a non-porous topmost second backside layer, over the porous first backside layer, that comprises at least 80% poly(vinyl alcohol), by weight solids, wherein the coverage of the second backside layer is at least 2 $g/m^2$;

wherein the ratio of the total coverage of the coated layers on the backside to the total coverage of the ink-receiving layers on the frontside of the support is 25 to 65 percent.

17. An inkjet printing process comprising the steps of:

(A) providing an inkjet printer that is responsive to digital data signals;

(B) loading the inkjet printer with an inkjet recording element as described in claim 1;

(C) loading the inkjet printer with a inkjet ink composition; and (D) printing on the inkjet recording element using the inkjet ink composition in response to the digital data signals.

* * * * *